United States Patent [19]

Stang

[11] 4,364,233

[45] Dec. 21, 1982

[54] FLUID ENGINE

[75] Inventor: John H. Stang, Columbus, Ind.

[73] Assignee: Cummins Engine Company, Inc., Columbus, Ind.

[21] Appl. No.: 221,798

[22] Filed: Dec. 31, 1980

[51] Int. Cl.[3] ..... F02G 1/02

[52] U.S. Cl. ..... 60/712; 60/516; 60/517

[58] Field of Search ..... 60/516, 517, 525, 526, 60/712; 123/1 R

[56] References Cited

U.S. PATENT DOCUMENTS 155,087 9/1874 Hirsch ..... 60/712 X 2,484,392 11/1949 Van Heeckeren ..... 60/517

2,657,553 11/1953 Jonkers ..... 60/517

4,004,421 1/1977 Cowans ..... 60/516

*Primary Examiner*—Allen M. Ostrager

*Attorney, Agent, or Firm*—Sixbey, Friedman & Leedom

[57] ABSTRACT

A modified Stirling cycle type engine (10) includes a pair of cylinders (12,14) in which pistons (16,18) are reciprocably mounted to define a hot and cold side to the engine, a passageway (30) interconnecting the cylinders (12,14) and a regenerator (32) and a cooler (34) in the passageway (30). Exhaust and intake valves (50,54) permit exhaust of working fluid from and supply of fresh air to the hot side. A fuel injector (38) and fuel igniting means (36) are provided for injecting fuel into the passageway (30) adjacent the hot side for admixture with working fluid passing therethrough and ignition within the hot side cylinder (12).

10 Claims, 6 Drawing Figures

FLUID ENGINE

DESCRIPTION

1. Technical Field

The present invention relates to a heat powered engine and, more particularly, to a Stirling-cycle type thermal engine with internal combustion.

2. Background Art

The conventional Stirling cycle engine operates on the principle that work output can be derived from compressing and expanding a working fluid within a closed volume and transferring the fluid between relatively hold and cold chambers interconnected by a flow path which generally includes heater, regeneraor and cooler elements. In a typical configuration a pair of pistons operate in associated and interconnected cylinders which include annularly disposed heater, regenerator and cooler components in the interconnecting flowpath. The working fluid on the hot side is maintained at a relatively high temperature by the heater and on the cold side is maintained at a relatively low temperature by the cooler. The regenerator absorbs and stores thermal energy from the working fluid during the portion of the engine cycle during which the fluid moves from the hot to the cold side chamber and releases its stored thermal energy to the working fluid during the portion of the engine cycle during which the fluid moves from the cold to the hot side chambers. This typical configuration is shown, for example, in U.S. Pat. Nos. 2,484,392 and 2,657,553 illustrating exemplary Stirling cycle arrangements for refrigeration applications.

However, conventional Stirling cycle engines suffer numerous practical shortcomings which limit their usefulness. For example, the Stirling cycle operates at high mean cycle pressures, about 3200 psia, and this condition, together with the need for relatively high volume flow capability makes it impossible, with available technology, to provide an effective heater component having adequate longterm mechanical and thermal reliability at an economical cost. Best estimates are that an adequate heater for practical usage, even if possible to obtain, could represent as much as half the cost of the engine. In addition, the high mean cycle pressures of the Stirling cycle engine impose material and structural requirements on the cylinder block which are expensive to meet. Furthermore, maintaining the closed volume required of a conventional Stirling cycle engine poses difficult sealing problems both in keeping the working fluid in and, to prevent heater and other component damage, in keeping crankcase oil leakage out.

In an effort to overcome many of the shortcomings of conventional Stirling cycle engines various modifi-thereto have been made thereto. For example, U.S. Pat. No. 4,004,421 to Cowans discloses a semi-closed Stirling cycle engine configuration in which a portion of the cold side working fluid is replaced by fresh air during each cycle via a positive displacement compressor-expander coupled to the crankshaft. The Cowans engine replaces the conventional heater of conventional Stirling cycle engines with a fuel injector and igniter for causing internal combustion within the hot side cylinder. In addition, the conventional cooler is deleted and, in lieu thereof, coolant passageways are provided in the engine block. However, notwithstanding the modifications designed to overcome conventional Stirling cycle engine shortcomings these Cowans engine modifications introduce significant drawbacks which render the engine inefficient and impractical. For example, removing working fluid from the cold side chamber effectively raises the hot side chamber temperature with the result that regenerator temperatures exceed those which are consistent with useful regenerator life. Thus, if as in Cowans, the regenerator temperature exceeds 1200°-1400° F., no available regenerator configuration and material can provide a practical useful life. Moreover, providing coolant passageways in the engine block does not accomplish sufficient-cooling to maintain the cold side temperature and the engine tends toward isothermal operation. In addition, by coupling the turbocharger to the engine crankshaft, engine shaft work is used to drive the compressor, thereby diminishing the overall work output of the engine. The net result is that the Cowans engine is neither thermally efficient nor economical.

DISCLOSURE OF THE INVENTION

It is, therefore, an object of the present invention to provide a modified Stirling cycle engine which is practical in terms of its equipment requirements and which is thermally efficient.

It is another object of the invention to provide a modified Stirling cycle engine which exhibits improved efficiency and economics by providing an advantageous turbocharger configuration and means for operatively associating the turbocharger with the engine.

It is yet another object of the invention to provide a modified Stirling cycle engine which most efficiently utilizes internal combustion for producing thermal energy convertible to engine work.

It is yet another object of the invention to provide a modified Stirling cycle engine which operates at a low mean cycle pressure and, therefore, reduces hardware costs.

It is another object of the invention to provide a modified Stirling cycle engine which produces little smoke and low combustion-originated noise and is therefore environmentally attractive.

Other objects and advantages will become apparent from the following description and appended claims.

In accordance with the foregoing objects the present invention provides a modified Stirling cycle engine comprising means defining a hot side chamber and a cold side chamber; means defining a passageway interconnecting the hot and cold side chambers; a hot side piston and a cold side piston respectively reciprocably mounted in the hot and cold side chambers for varying the volume thereof; means for connecting the pistons in a predetermined phased relationship for producing a rotary output in response to reciprocation of the pistons; a regenerator in the passageway between the hot and cold side chambers for removing heat from working fluid, preferably air, directed from the hot to the cold side chamber and adding heat to working fluid directed from the cold to the hot side chamber; a heat exchanger in the passageway between the regenerator and the cold side chamber for removing heat from the working fluid in the passageway, whereby the cold side temperature can be maintained within a predetermined range; means for injecting fuel into the interconnecting passageway as working fluid is directed from the cold to the hot side chamber, whereby turbulence within the passageway assures complete working fluid-fuel mixing; means for initiating combustion within the hot side chamber; and means for admitting predetermined quantities of fresh air to and exhausting predetermined quantities of working fluid and combustion products from the hot side chamber.

Most desirably, fresh air intake and working fluid exhaust valves in the hot side chamber communicate with a free-floating or independent turbocharger. Working fluid and combustion products exhausted from the hot side chamber operate an expander turbine which, in turn, drives a compressor to supply compressed fresh air to the hot side chamber. Optionally, the turbine is linked to the crankshaft and energy produced by the turbine which is not needed to run the compressor is utilized to supplement the engine energy output.

BEST MODE FOR CARRYING OUT THE INVENTION

The present invention comprises a modified conventional Stirling cycle engine whose operating cycle is basically a Stirling cycle proceeding in four overlapping steps inside a semi-closed volume containing two pistons operating in hot and cold side chambers, a regenerator and a cooler. The working fluid, which will generally be air, on the hot side is kept at a high temperature by burning fuel and on the cold side is kept at a low temperature by the cooler. The volume is considered semi-closed because a portion of the working fluid, which is generally a mixture of air and combustion products, is replenished during each cycle with fresh air. The working fluid rises in temperature during compression and heat addition and cools during expansion and heat rejection. There is a power stroke for every revolution of the crankshaft.

Figure 1:
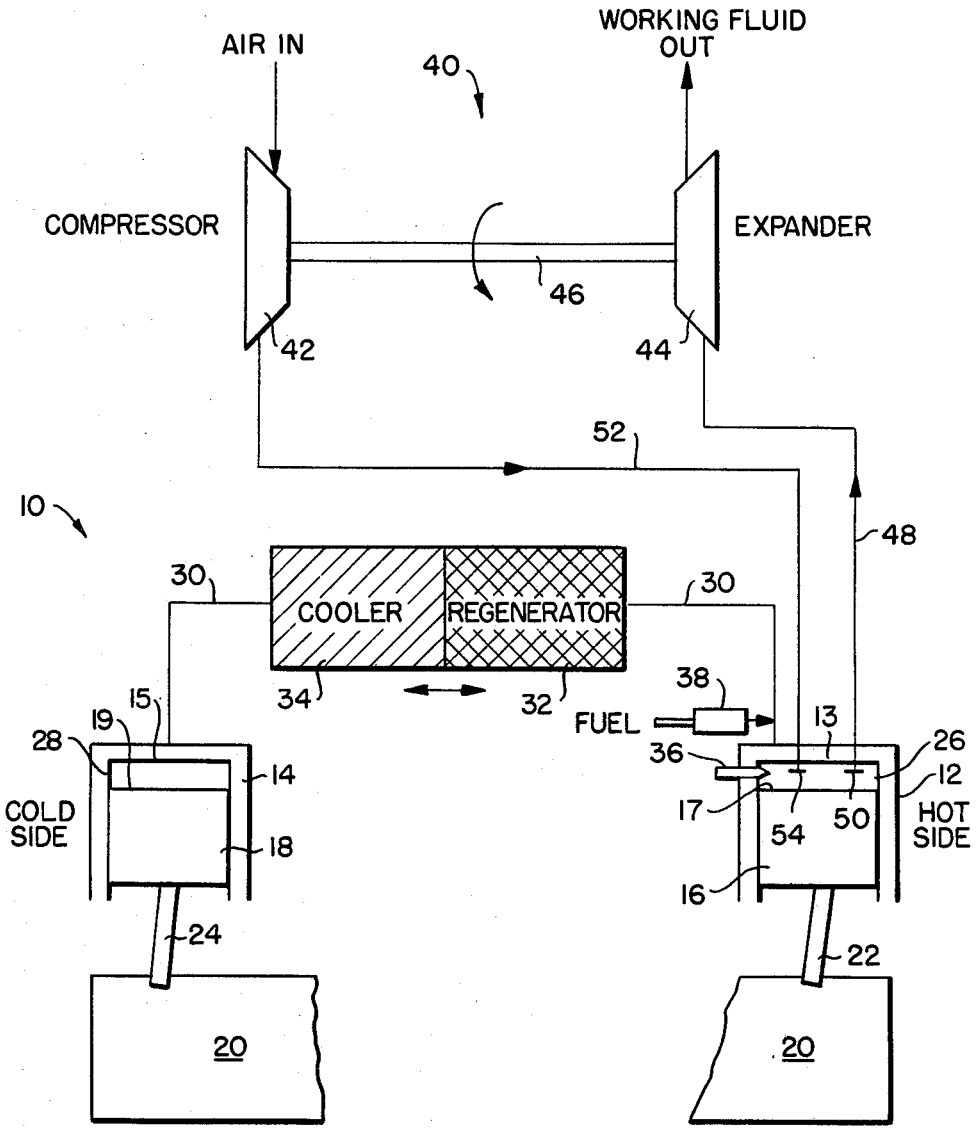
FIG. 1 schematically illustrates one embodiment of an engine in accordance with the present invention.

FIG. 1 depicts the essential elements of the engine 10 in simplified schematic form and will be described hereinafter utilizing air as the primary component of the working fluid. Only two cylinders are depicted although it will be appreciated that the engine can incorporate as many cylinders as desired and the cylinders may be parallel and arranged in-line or they may be arranged in conventional V-shape (see FIGS. 2–5) at any practical angle such as 90° or less, all as is well known in the art. It will also be appreciated that the engine 10 is typically disposed within an engine housing (not shown) of convenient construction and configuration for the intended purpose.

Engine 10 includes a hot side cylinder 12, a cold side cylinder 14 and hot and cold side pistons 16, 18 respectively mounted within cylinders 12,14 for reciprocating movement along the axis of the cylinders. The pistons reciprocate in the cylinders with a phase displacement of about 90° and are operatively associated with a conventional crankcase 20 by means of piston drive rods 22,24 whereby, in conventional fashion, a rotary output is produced in response to piston reciprocation. Details of the crankcase configuration and/or operation are omitted inasmuch as any of a wide variety of well known commercial expedients can be used. Inasmuch as the modified engine of the present invention operates at much lower mean and peak cylinder pressures (about 200 psia mean and 400 psia peak) compared with conventional diesel engines and, particularly compared with conventional Stirling cycle engines, a much lighter cylinder block can be used. Moreover, since the working fluid volume of the modified engine of the present invention is not sealed closed, the piston seals required are not of the high cost type normally required in conventional Stirling engines.

Each cylinder includes a working fluid space defined between the upper surface of the piston and the cylinder head. Thus, hot space 26 includes the working fluid volume between upper surface 17 of piston 16 and the head 13 of hot side cylinder 12. Cold space 28 is defined by the working fluid volume between upper surface 19 of piston 18 and the head 15 of cold side cylinder 14. A working fluid passageway 30 interconnects the hot and cold spaces 26,28 providing a conduit for the flow of working fluid therebetween. The hot and cold spaces 26,28 and interconnecting passageway 30 substantially comprise the working fluid containment volume for Stirling cycle operation. A heat regenerator 32 is disposed in passageway 30 for removing heat from working fluid passing therethrough from the hot to the cold space and for supplying heat to working fluid moving therethrough from the cold to the hot space. The regenerator may be of any conventional type appropriately sized in terms of surface density frontal area, flow length and flow channel configuration to perform its heat exchange function and formed of materials suitable to withstand the flow rates and working fluid temperatures, up to about 1200°–1400° F., likely to be encountered in this type engine. Preferably, the regenerator will be a matrix surface having very high surface density. Exemplary of a suitable surface is square mesh wire having a surface density of about 4800 $ft^2/ft^3$. Metals or ceramics are likely to be the structural material of choice. Care should be exercised that the working fluid channels do not cause laminar flow resulting in lower heat transfer coefficients and do not become traps for soot particles which may result from combustion.

A cooler 34 is also disposed in passageway 30 between the regenerator 32 and the cold space 28. Typically, the cooler may comprise a circular tube pack of plain, staggered 0.1 inch OD circular tubing having a surface density of about 250 $ft^2/ft^3$, a frontal area of about 50 $in^2$ and a flow length of about 0.80 inches. The working fluid flows over the outside diameter of the tubes while cooling water or other appropriate and readily available relatively cold heat exchange fluid passes through the tubes. The cooler 34 operates continuously during engine operation to assure maintenance of the predetermined cold space temperature.

A conventional fuel ignition device 36 powered by a conventional energy source (not shown) and including appropriate control circuitry (not shown) is mounted within hot space 26 to ignite a combustible fuel-air mixture supplied to the hot space. The combustible fuel may, depending upon the engine, be diesel fuel, gasoline, propane or other known fuels. The fuel is supplied via direct injection through fuel injector 38 to the interconnecting passageway 30 between regenerator 32 and hot space 26, preferably at a point proximate the hot space 26. As will be discussed hereinafter, fuel is injected into passageway 30 at a point in the engine cycle during which working fluid is forced from the cold space 28 through passageway 30 into the hot space 26. It is expected that the working fluid stream velocity in the passageway is 200–400 ft/sec. Thus, fuel metered into this rapidly moving stream, preferably in an atomized state, will be thoroughly admixed with the air by the natural, internal engine air motion and will enter hot space 26 as a fuel-air mixture ready for ignition by ignition device 36. Details of the ignition device, energy source, control circuitry and fuel injector, and the operation thereof, are omitted inasmuch as any of a wide variety of well known commercially available configurations can be used.

A turbocharger system 40 is provided to continuously furnish fresh air to and to continuously extract working fluid (air plus combustion products) from the hot space 26 during engine operation. Preferably, the turbocharger system is totally independent of the engine crankshaft and drive train and operates in a free floating manner. In this preferred embodiment the turbocharger system 40 includes a compressor 42, an expander 44 and a shaft 46 interconnecting the compressor and expander whereby the former may be directly driven by the latter. Both the expander and compressor are commercially available type units well known to the art having efficiencies of at least 70 to 75%. Expander 44 is coupled to hot space 26 via exhaust conduit 48 and exhaust valve 50. Compressor 42 is coupled to hot space 26 via supply conduit 52 and intake valve 54. The expander and compressor may be coupled to the hot space either in the cylinder per se or anywhere along passageway 30 on the hot side of regenerator 32. As will be described more fully hereinafter, during the heat rejection phase of the engine cycle, approximately 10 to 20% of the working fluid containment volume is replaced by fresh air. Working fluid under pressure is forced out of the hot space 26 through exhaust valve 50 and exhaust conduit 48 by upward movement of piston 16. The exhausted fluid expands through expander 44 producing shaft energy which, through shaft 46, operates compressor 42. Ambient air supplied to compressor 42 is thereby pressurized and directed via supply conduit 52 and intake valve 54 to the hot space 26. Exhaust and intake valves 50,54 are operated in timed relationship to the engine cycle, for example, by a conventional mechanical, electrical or hydraulic valve control system (not shown). The details of configuration and operation of such valve control systems are omitted inasmuch as they are well known to the art and commercially available. The turbocharger system can, if sufficient energy is available in the hot space working fluid exhaust, be linked to (but not driven by) the engine crankshaft and excess shaft energy produced by expander 44 beyond that needed to operate compressor 42 used to supplement the engine output. Although in such an arrangement the turbocharger is no longer free floating, neither is it dependent upon engine output for its power. An advantage of either a free floating or independent turbocharger, i.e., a turbocharger that is not driven by the engine, is that it operates at substantially the same airflow irrespective of engine speed. Therefore, when it is desired to bring an engine operating at part speed, up to full speed, there is no time lag waiting for the turbocharger to come up to speed. For these reasons at least, the free floating or independent turbocharger represents an improvement over positive displacement compressor-expander systems which are driven by the engine crankshaft.

Figure 5:
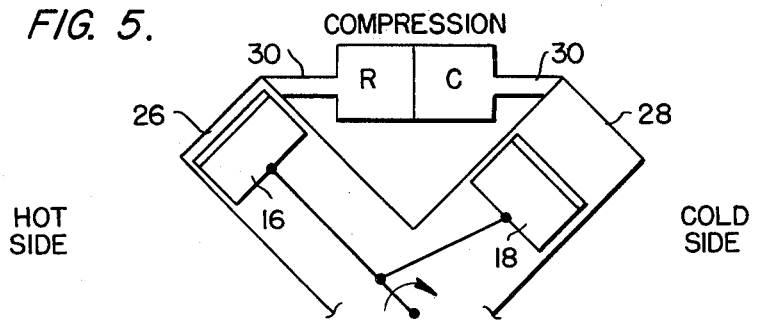
Figure 6:
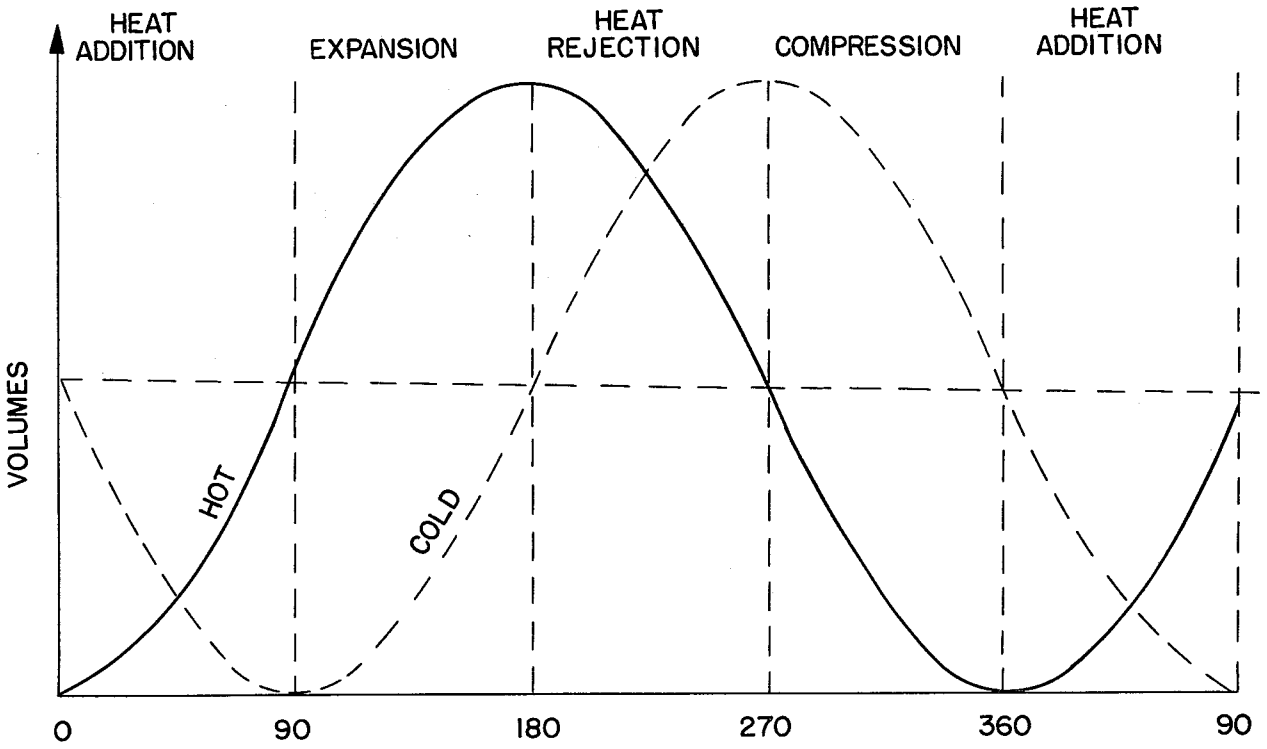
FIG. 6 is a graphical illustration of the hot and cold side chamber volumes at various points in the cyclic operation of an engine in accordance with the present invention.

Operation of the modified Stirling cycle engine of the present invention may be better understood by reference to FIGS. 2–5 wherein the position of pistons 16,18 and the direction of working fluid flow at various points in a cycle of operation are shown. Reference should also be made to FIG. 6 wherein hot and cold space volume at various points in a cycle of operation are graphically illustrated. The hot space volume is shown as a solid line whereas the dotted line represents the concurrent cold space volume.

Figure 2:
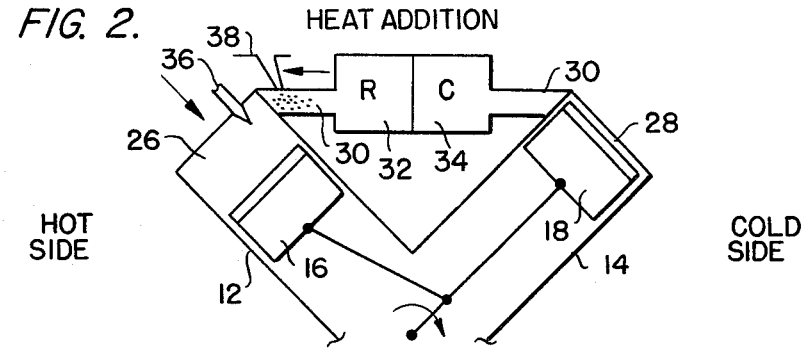
FIGS. 2–5 schematically illustrate piston position at various points in the cyclic operation of an engine in accordance with the present invention.

FIG. 2 represents a point in the engine operating cycle wherein the hot side piston 16 has moved downwardly within cylinder 12 from its uppermost position toward a midway position. At the same time, cold side piston 18 has moved upwardly within cylinder 14 from a midway position toward its uppermost position. The result is that the working fluid in cold space 28 is forced by piston 18 into interconnecting passageway 30, through cooler 34 and regenerator 32 and into hot space 26. During passage through passageway 30, the working fluid absorbs heat from regenerator 32 (which had been heated by the passage of hot working fluid therethrough in the heat rejection step of the previous ccle). In addition, fuel is injected into the working fluid in passageway 30 through injector 38 and the resulting air-fuel mixture is ignited within the hot space f26 of cylinder 12 by ignition device 36, such as a sparkplug, to produce hot combustion products. Heat is transferred to the working fluid from the regenerator at about the same time as fuel is burned. The two functions are complementary. In fact, for an engine design with an overall compressor ratio of 3:1, the heat release from the burning fuel will be approximately equal the heat transfer from the regenerator. Thus, the cold working fluid is heated by heat transfer from the regenerator and by admixture with hot combustion products. This step of the cycle, known as the heat addition step, is represented in FIG. 6 on the solid line curve by an increase in hot space volume as the hot side piston moves downwardly from its uppermost position. On the dotted line curve, the movement of the cold side piston toward its uppermost position is shown by a decrease in cold space volume.

Figure 3:
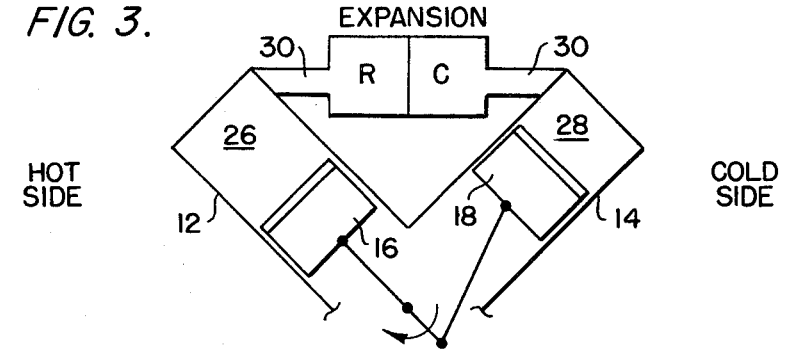
Figure 4:
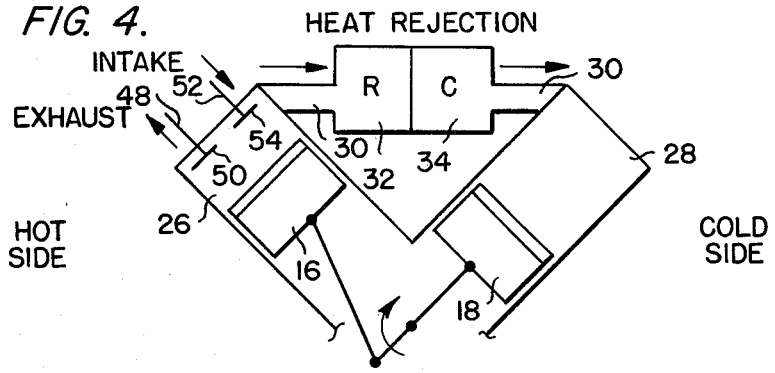

In the next step of the cycle, known as the expansion step because the relatively hot working fluid in the hot space expands, the downward movement of the hot side piston continues toward a lowermost position within cylinder 12. It is during this step that energy is extracted from the engine in the form of rotary output in response to recirpocation of the piston. At the same time the cold side piston 18 begins to move from its uppermost position toward a midway position. This step is illustrated in FIG. 3 wherein pistons 16 and 18 are approximately in their respective lowermost and midway positions. In FIG. 6 the solid line curve shows a continuing increase in hot space volume as the hot side piston 16 moves toward its lowermost position. The dotted line curve shows an increase in cold space volume as cold side piston 18 moves downwardly from its uppermost position. It will, therefore, be appreciated that there is a net overall working fluid volume increase during this step while the working fluid is hot.

The next step commences as the hot side piston 16 begins its upward travel, forcing the hot working fluid out of hot space 26 into passageway 30, through regenerator 32 and cooler 34 and into cold space 28. At the same time, cold side piston 18 continues its downward travel from a midway position toward its lowermost position. See FIG. 4. During passage through passageway 30, the hot working fluid gives up its heat to regenerator 32 and is further cooled in cooler 34, e.g., by the flow of cooling water through the tubes thereof. Overall, during this heat rejection step the working fluid is forced from the hot space to the cold space and is cooled. Exhaust valve 50 is opened for a sufficient time during this step for hot side piston 16 to force about 10–20% of the hot space working fluid into exhaust conduit 48 for expansion through and operation of expander 44. Compressor 42 is driven by expander 44 via shaft 46, drawing in ambient fresh air and supplying compressed fresh air via supply conduit 52 to hot space 26 through intake valve 54 which is open during this step for a sufficient period to replenish the 10–20% of the working fluid exhausted via valve 50. In this manner, about 10–20% of the working fluid volume is replaced each cycle with fresh air to replenish the oxygen supply for combustion and, it is for this reason, that the modified Stirling cycle engine of the present invention is considered to operate in a semi-closed cycle. This heat rejection step is represented in FIG. 6 on the solid line curve by a decrease in hot space volume attributable to the movement of the hot side piston from its lowermost position to a midway position. On the dotted line curve, the movement of the cold side piston toward its lowermost position is shown by an increase in cold space volume.

The last cycle step, with intake and exhaust valves now closed, is the compression step during which the hot side piston 16 continues its upward movement toward its uppermost position and the cold side piston 18 begins its upward travel from its lowermost position toward a midway position. FIG. 5 shows the approximate final hot and cold side piston positions for this step. The working fluid trapped in hot space 26, passageway 30 and cold space 28 is compressed by the upward movement of the pistons which results in an overall working fluid volume decrease while the working fluid is relatively cool. This volume decrease is shown in FIG. 6 wherein the solid line curve shows a continuing decrease in hot space volume as piston 16 moves toward its uppermost position and the dotted line curve shows a continuing decrease in cold space volume as piston 18 moves toward its midway position.

Upon completion of the compression step the hot and cold side pistons are in position to repeat the heat addition step and, sequentially thereafter, the expansion, heat rejection and compression steps. Operating the engine of the present invention in this fashion permits internally generated thermal energy to be used directly for the generation of work. The working fluid has expanded while hot and was compressed while cold. The result is a net work output from the burning fuel. In one specific configuration, employing two 7.0 inch bore cylinders with a 6.5 inch stroke, an overall compression ratio of 3.09 and an air-fuel ratio of 18, in steady state operation the mean hot space temperatures ranged from 1200°–2000° F., the mean cold space temperatures ranged from 300°–500° F., the peak cylinder pressures ranged from 404–569 psia. For turbine/compressor efficiencies in the range 70 to 85%, the overall thermal efficiency of the cycle ranged from 35–39% and the rated power output at 1900 rpm ranged from about 125 to 166 bhp.

INDUSTRIAL APPLICABILITY

The modified Stirling-cycle engine of the present invention has application wherever diesel engines are used, but has particular applicability to diesel engines intended for powering vehicles, such as automotive engines. The engine is well suited for these uses because the very low mean and peak engine operating pressures permit use of drastically lighter weight materials than on conventional diesel engines for the cylinder block and associated components; the use of a free floating or independent turbocharger facilitates rapid engine response time and may, in some cases, supplement engine power output; the semiclosed cycle reduces sealing problems, allows usage of more or less conventional piston rings and other seals and, thereby, makes the engine durable and rugged; the relatively low engine operating temperatures allows practical usage of engine components, such as regenerators, which can reasonably be expected to be long-lived and economical; and, the engine is environmentally attractive due to its low smoke production and low combustion-originated noise levels.

I claim:

1. An internal combustion Stirling cycle engine comprising:

(a) means defining a hot side chamber and a cold side chamber;

(b) means defining a passageway interconnecting said hot and cold side chambers;

(c) a hot side piston and a cold side piston respectively reciprocably mounted in said hot and cold side chambers for varying the volume thereof;

(d) means for connecting said pistons in a predetermined phased relationship for producing a rotary output in response to reciprocation of said pistons;

(e) a regenerator in said passageway between said hot and cold side chambers for removing heat from working fluid directed from said hot to said cold side chamber and adding heat to working fluid directed from said cold to said hot side chamber;

(f) a heat exchanger in said passageway between said regenerator and said cold side chamber for removing heat from said working fluid in said passageway whereby the cold side temperature can be maintained within a predetermined range;

(g) means for injecting fuel into said interconnecting passageway between said regenerator and said hot side chamber as working fluid is directed from said cold to said hot side chamber, whereby turbulence within said passageway insures complete working fluid-fuel mixing;

(h) means for initiating combustion within said hot side chamber; and (i) means for admitting predetermined quantities of fresh air to and exhausting predetermined quantities of working fluid and combustion products from said hot side chamber.

2. Apparatus as in claim 1 wherein said means for admitting comprises intake valve means communicating with said hot side chamber and compressor means associated with said intake valve means for providing fresh air to said hot side chamber through said intake valve means.

3. Apparatus as in claim 2 wherein said means for exhausting comprises exhaust valve means communicating with said hot side chamber and expander means associated with said exhaust valve means for receiving working fluid and combustion products from said hot side chamber through said exhaust valve means.

4. Apparatus as in claim 3 including means operatively associating said expander means with said compressor means.

5. Apparatus as in claim 4 wherein said operatively associating means is a drive shaft and said expander means drives said compressor means via said shaft.

6. Apparatus as in claim 5 wherein said expander means is driven by said working fluid and combustion products to produce shaft work.

7. Apparatus as in claim 6 including means operatively associated with said expander means and said piston connecting means for utilizing a portion of said shaft work to supplement said rotary output.

8. Apparatus as in claim 1 wherein said regenerator comprises a matrix surface having high surface density and said cooler comprises a plurality of tubes through which a relatively cool heat exchange fluid flows.

9. Apparatus as in claim 6 wherein said means defining hot and cold side chambers comprise hot and cold side cylinders, said regenerator comprises a matrix surface having high surface density, said cooler comprises a plurality of tubes through which a relatively cool heat exchange fluid flows and said combustion initiating means comprises a sparkplug.

10. Apparatus as in claim 6 wherein said means defining hot and cold side chambers comprise hot and cold side cylinders and said cylinders are arranged with their respective longitudinal axes at an angle of 90° or less.

* * * * *